US010472028B2

(12) United States Patent
Ardoin

(10) Patent No.: US 10,472,028 B2
(45) Date of Patent: Nov. 12, 2019

(54) ANCHOR LIGHT

(71) Applicant: Buckey John Ardoin, Ville Platte, LA (US)

(72) Inventor: Buckey John Ardoin, Ville Platte, LA (US)

( * ) Notice: Subject to any disclaimer, the term of this patent is extended or adjusted under 35 U.S.C. 154(b) by 0 days.

(21) Appl. No.: 16/044,482

(22) Filed: Jul. 24, 2018

(65) Prior Publication Data

US 2019/0023363 A1 Jan. 24, 2019

Related U.S. Application Data

(60) Provisional application No. 62/536,245, filed on Jul. 24, 2017.

(51) Int. Cl.

| | |
|---|---|
| ***B63B 45/04*** | (2006.01) |
| ***F21V 21/14*** | (2006.01) |
| ***F21V 21/26*** | (2006.01) |
| *F21V 23/02* | (2006.01) |
| *F21V 23/04* | (2006.01) |
| *F21W 111/04* | (2006.01) |

(52) U.S. Cl.

CPC ..... *B63B 45/04* (2013.01); *F21V 21/14* (2013.01); *F21V 21/26* (2013.01); *F21V 23/02* (2013.01); *F21V 23/04* (2013.01); *F21W 2111/04* (2013.01)

(58) Field of Classification Search

CPC ..... B63B 45/04; F16M 11/06; F16M 11/10; F16M 11/18; F21V 21/26

See application file for complete search history.

(56) References Cited

U.S. PATENT DOCUMENTS

| | | | | |
|---|---|---|---|---|
| 4,706,172 A * | 11/1987 | Lebowitz | ..... | F16M 11/40 174/117 FF |
| 5,370,348 A * | 12/1994 | Toth | ..... | B63B 45/04 248/289.11 |
| 6,164,803 A * | 12/2000 | Reniger | ..... | B60Q 1/2657 114/353 |
| 6,394,634 B2 * | 5/2002 | Kitchin | ..... | B63B 45/02 362/477 |

OTHER PUBLICATIONS

Apex Lighting, Hella Marine, 2NM All Round Anchor Lamp Fold-Down, Aug. 16, 2019, https://www.apexlighting.com/boat-lights/ led-navigation-lights/2nm-all-round-anchor-lamp-fold-down/.*

* cited by examiner

*Primary Examiner* — Anh T Mai
*Assistant Examiner* — Michael Chiang

(57) ABSTRACT

An anchor light used to fulfill coast-guard requirements consists of a lighting source, a lighting pole, a mounting plate, and a swivel mechanism. The lighting source is terminally connected to the lighting pole. Moreover, the lighting pole is rotatably engaged with mounting plate through the swivel mechanism so that the lighting pole can be positioned at a preferred angle. The swivel mechanism is laterally connected to the mounting plate which is mounted onto an external surface on the boat. More specifically, the mounting plate is mounted onto an anchor used on the boat. Upon establishing a connection between the anchor and the mounting plate, the user can utilize the swivel mechanism to rotate the lighting pole and connected lighting source to a preferred position.

7 Claims, 11 Drawing Sheets

ANCHOR LIGHT

The current application claims a priority to the U.S. Provisional Patent application Ser. No. 62/536,245 filed on Jul. 24, 2017.

FIELD OF THE INVENTION

The present invention relates generally to accessories used with an anchor. More specifically, the present invention is a light that is mounted onto the anchor.

BACKGROUND OF THE INVENTION

Certain rules and regulations apply when operating a boat at night. Most of these rules and regulations are set in place for safety purposes. Displaying an anchor light is one such rule used to provide safety to the boat operator and the boat. As with any safety regulation, certain standards need to be met when mounting an anchor light. Being a 360-degree white all-around light and having a two-mile visibility are among the main requirements for an anchor light.

Since most anchors are not designed to receive an external anchor light, boat owners use a variety of methods to fulfill the coast guard requirements. Connecting a light to an end of a pole and mounting the pole against the anchor is one commonly used method. Since the pole has no permanent mounting method, the pole must be repeatedly attached and detached. Due to the fixed height of the pole, setting the pole-and-light assembly at a preferred height may not be possible. Additionally, positioning the pole-and-light assembly at a preferred angle may not be possible due to the fixed mounting mechanism.

The objective of the present invention is to address the aforementioned issues. To do so, the present invention consists of a mounting mechanism that has the capability to mount onto an existing anchor. The present invention is designed and mounted so that the movement of the anchor and related components is not interrupted. Moreover, in contrast to other lighting devices, the present invention does not need to be removed when not in use. A swivel mechanism allows the present invention to be positioned at a preferred angle.

DETAIL DESCRIPTIONS OF THE INVENTION

All illustrations of the drawings are for the purpose of describing selected versions of the present invention and are not intended to limit the scope of the present invention.

The present invention is a lighting accessory that is intended to be used with an anchor on a boat. The present invention is intended to be mounted onto the anchor without making any modifications to the anchor. Additionally, the present invention is equipped with the ability to be positioned at a preferred angle.

Figure 1:
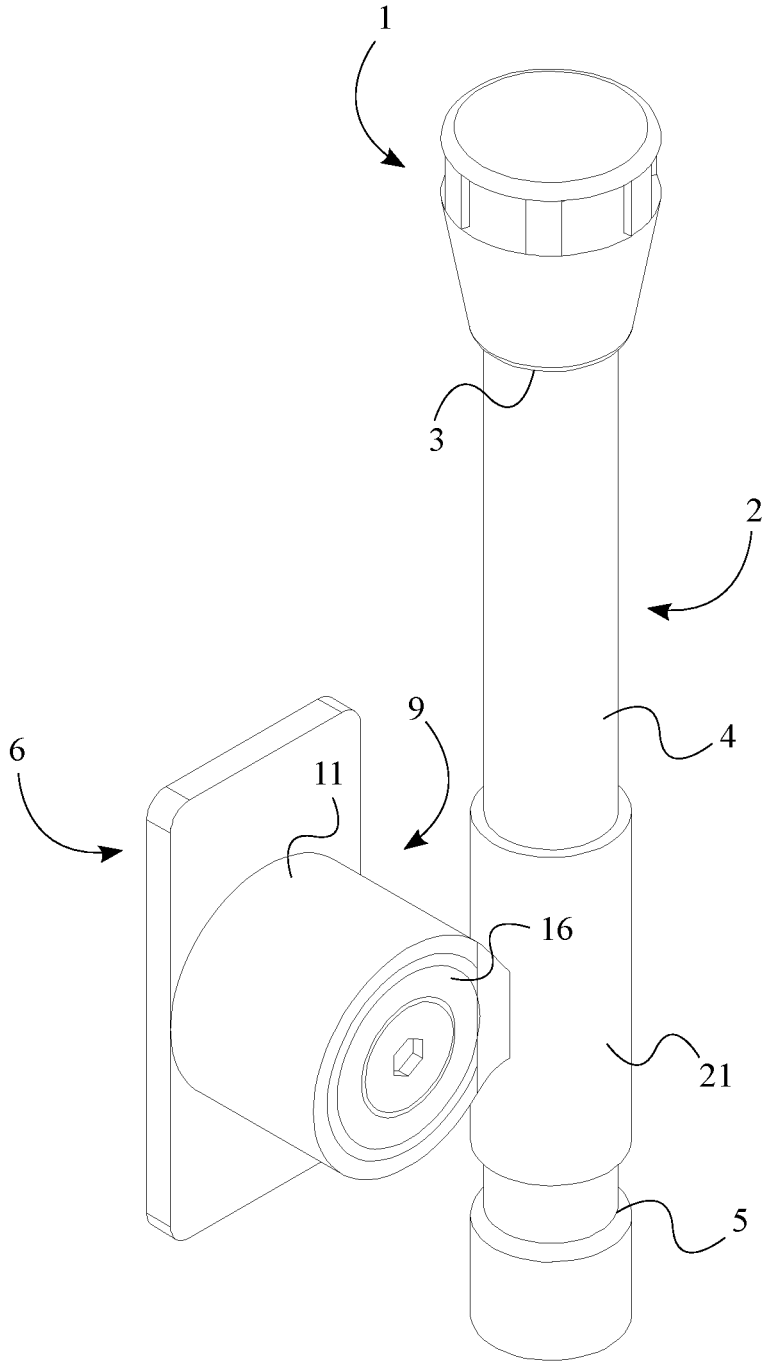
FIG. 1 is a perspective view of the present invention.
Figure 2:
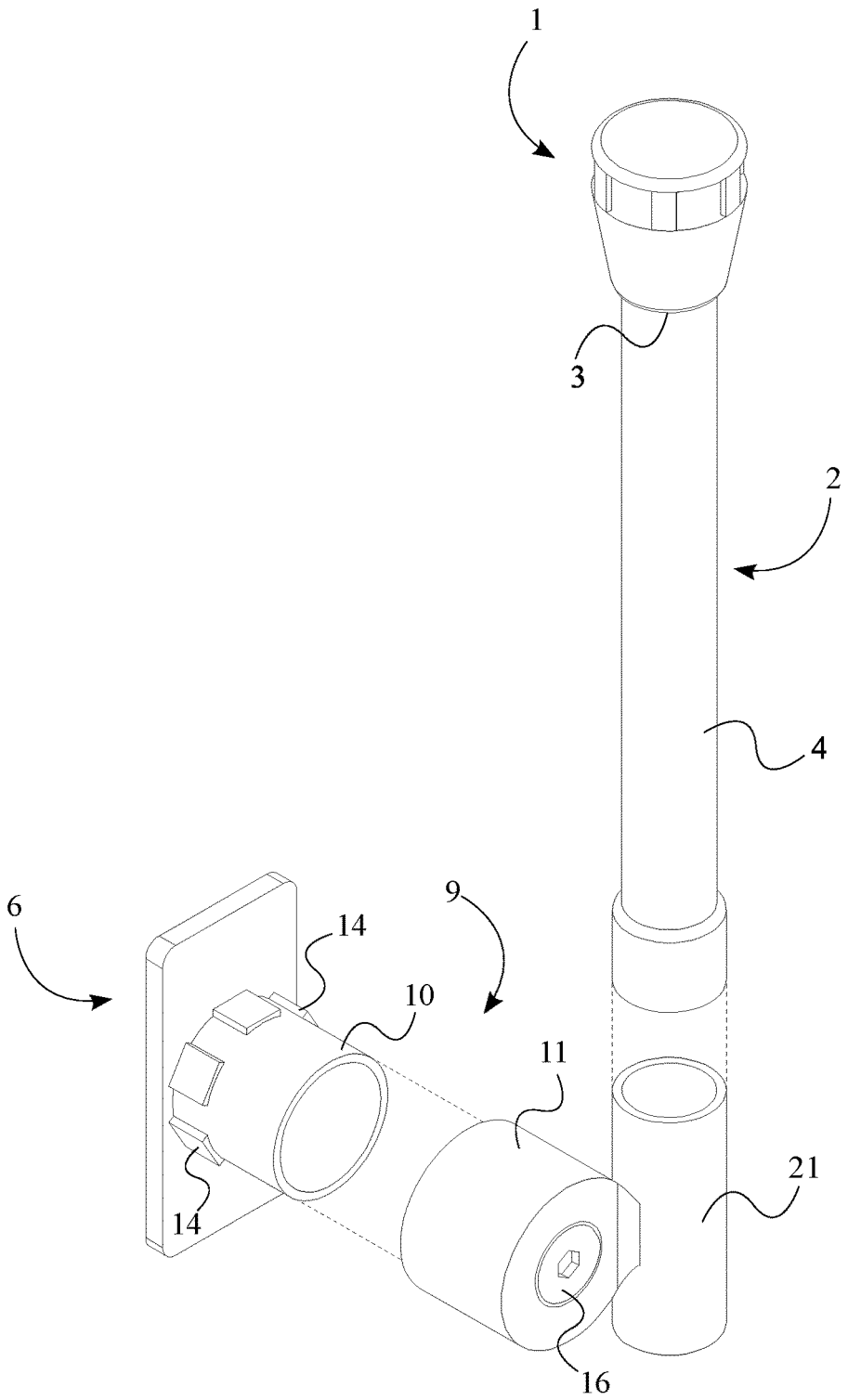
FIG. 2 is an exploded perspective view of the present invention.
Figure 3:
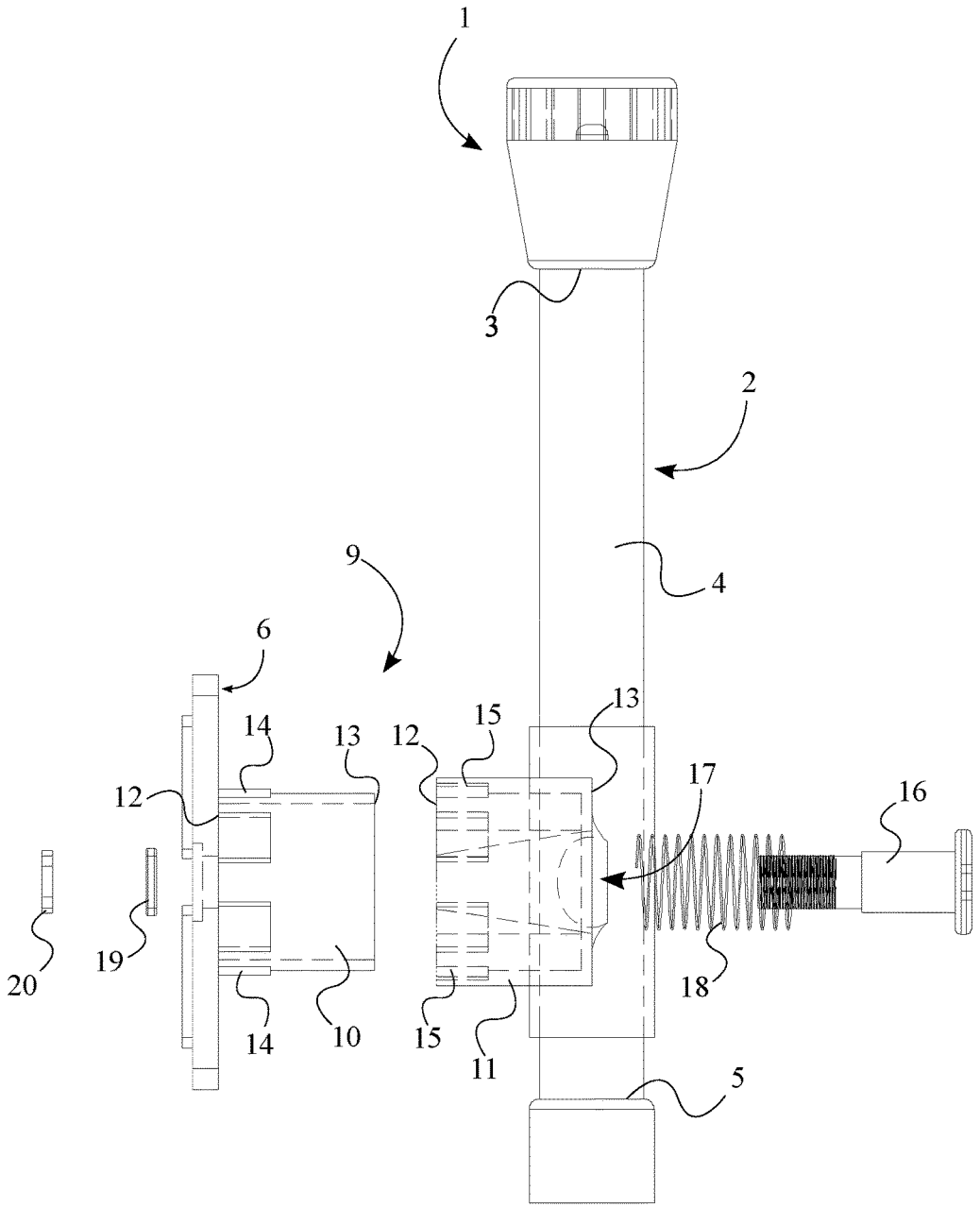
FIG. 3 is an exploded side view of the present invention.
Figure 4:
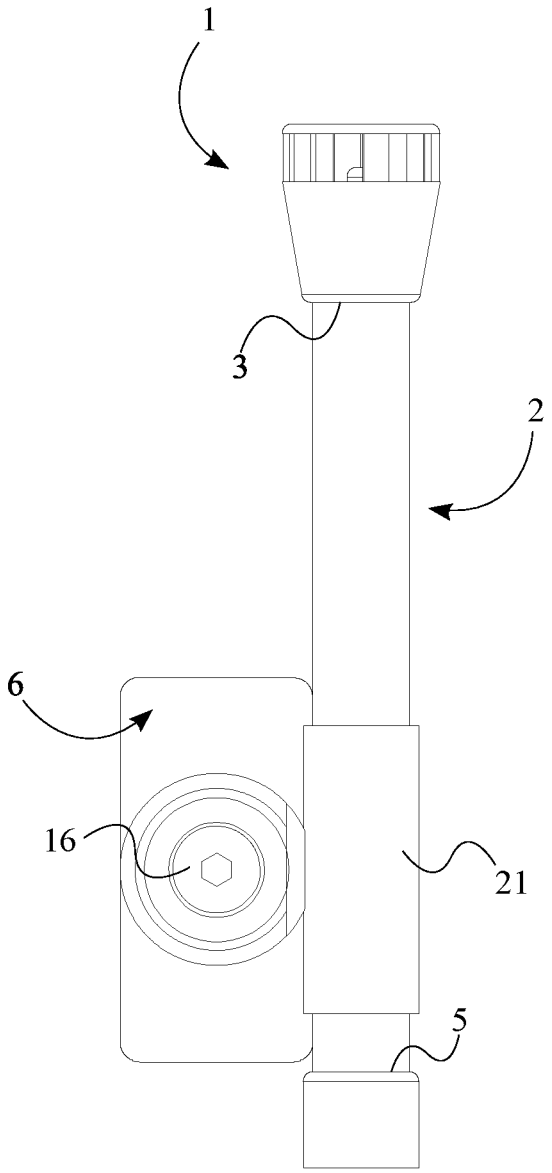
FIG. 4 is a front view of the present invention, wherein the lighting pole and lighting source is in a preferred position.
Figure 5:
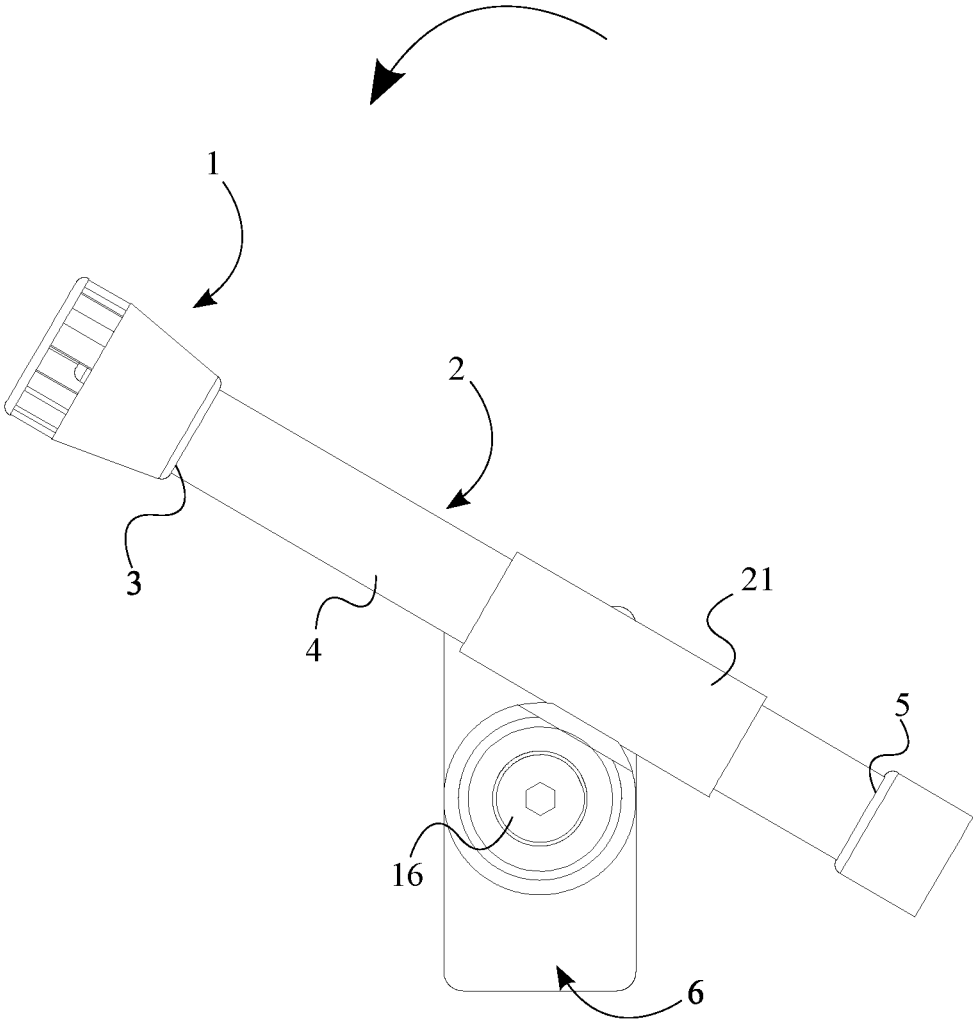
FIG. 5 is a front view of the present invention, wherein the lighting pole and the lighting source are positioned at an angle.
Figure 6:
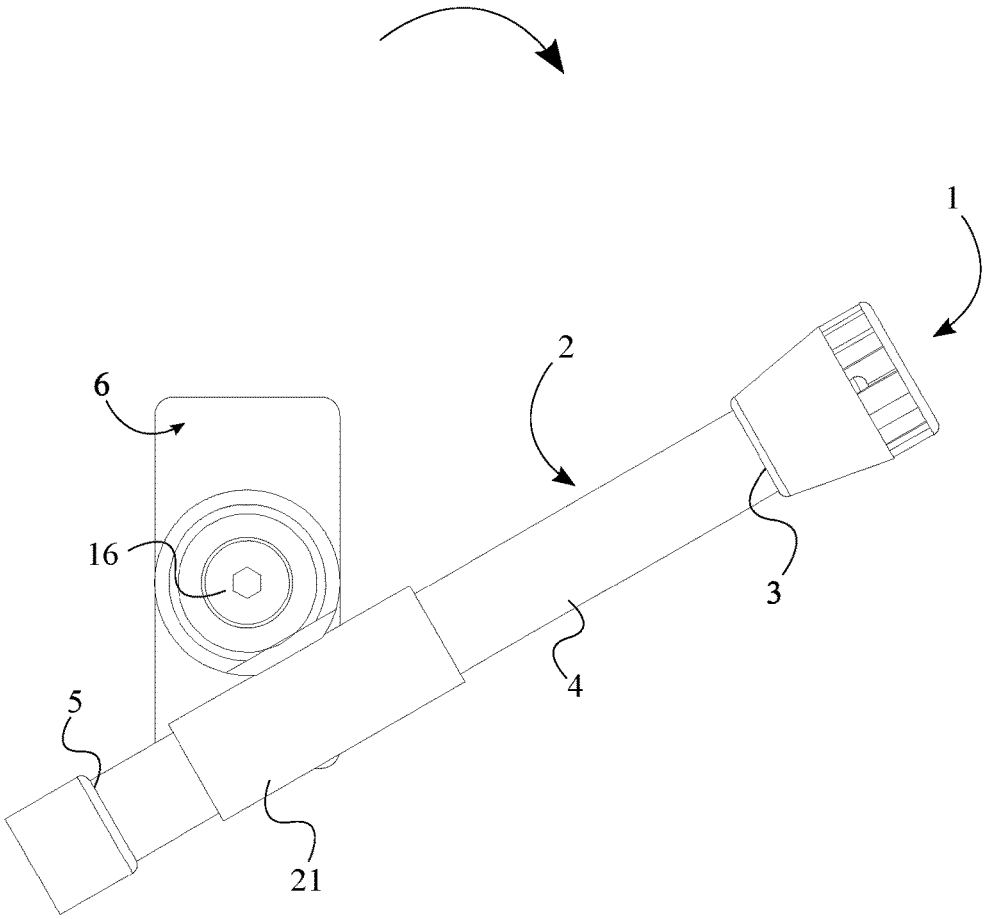
FIG. 6 is a front view of the present invention, wherein the lighting pole and the lighting source are positioned at a different angle.
Figure 7:
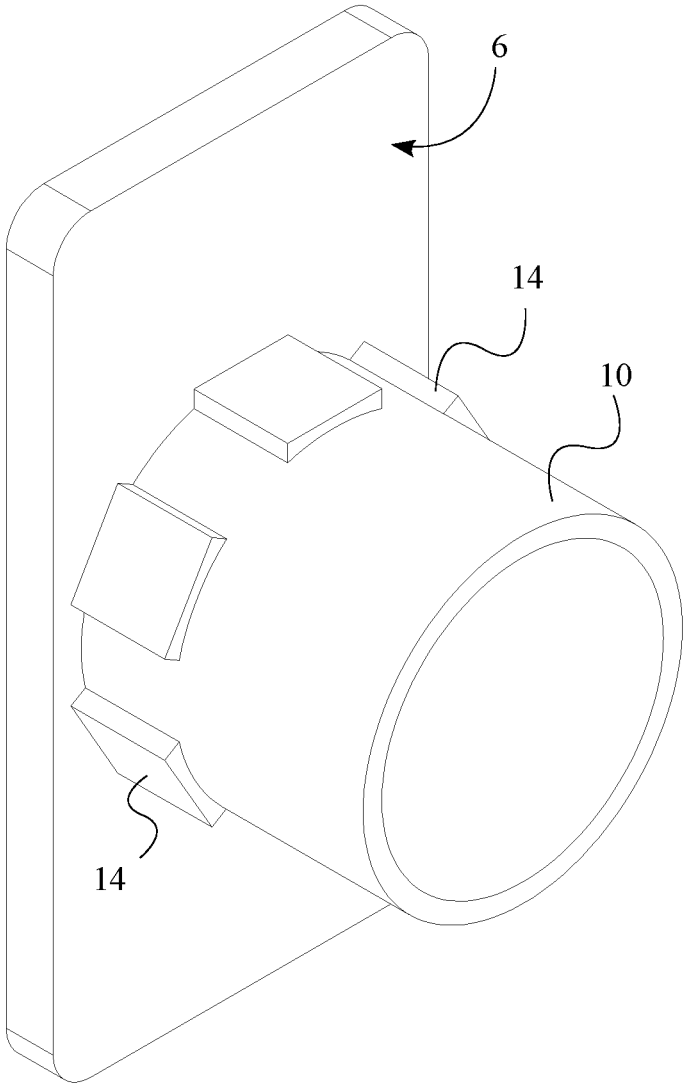
FIG. 7 is a perspective view of the first cylindrical body being perpendicularly connected to the mounting plate.

As illustrated in FIGS. 1-3, to fulfill the intended functionalities, the present invention comprises a lighting source 1, a lighting pole 2, a mounting plate 6, and a swivel mechanism 9. The lighting source 1, which is powered through an external power source 8, fulfills the illumination purposes. According to current coast-guard requirements, the light on the boat needs to be a white light with a two-mile visibility radius. The lighting source 1 of the present invention is selected to fulfill the necessary coast-guard requirements. The lighting pole 2 is used as an extension for the lighting source 1. The lighting pole 2 comprises a first end 3, a pole body 4, and a second end 5.

The pole body 4 extends from the first end 3 to the second end 5 and determines an overall length of the lighting pole 2. The overall length of the lighting pole 2 can vary in different embodiments of the present invention. For instance, in one embodiment of the present invention, the lighting pole 2 can be 12-inches long. In another embodiment of the present invention, the lighting pole 2 can be 18-inches long. The mounting plate 6 is used to attach the present invention onto an external surface of the boat. Since the present invention is designed to be mounted onto an anchor, the mounting plate 6 is used to establish a connection with the anchor of the boat. The swivel mechanism 9 is used to position the lighting source 1 at a preferred angle while being mounted onto the anchor. To do so, the lighting pole 2 is rotatably engaged with the mounting plate 6 through the swivel mechanism 9.

As mentioned earlier, the lighting source 1 is powered through the external power source 8. Preferably, the external power source 8 is a main power source used in the boat. However, the external power source 8 can vary in different embodiments of the present invention. To provide the required power, the lighting source 1 is electrically connected to the external power source 8. In the preferred embodiment of the present invention, a 12-Volt power source is used to illuminate the lighting source 1. However, in other embodiments, the overall power of the external power source 8 can vary according to the lighting source 1 that is being used. To obtain maximum extension through the lighting pole 2, the lighting source 1 is terminally connected to the lighting pole 2 at the first end 3. The pole body 4 is then rotatably engaged with the mounting plate through the swivel mechanism 9 adjacent the second end 5. In the preferred embodiment of the present invention, the swivel mechanism 9 is a pull and twist mechanism. However, the swivel mechanism 9 can be different in other embodiments of the present invention. The mounting plate 6 is laterally connected to the lighting pole 2 through the swivel mechanism 9. Since the mounting plate 6 remains stationary against the anchor of the boat, the lighting pole 2 can be positioned at a preferred angle by controlling the swivel mechanism 9. In other words, the lateral connection between the mounting plate 6, the swivel mechanism 9, and the lighting pole 2 allows the user to rotate the lighting pole 2 and the lighting source 1 about the mounting plate 6.

The swivel mechanism 9, which is a pull and twist mechanism in the preferred embodiment, can vary in different embodiments of the present invention. As seen in FIG. 3, in the preferred embodiment, the swivel mechanism 9 comprises a first cylindrical body 10, a second cylindrical body 11, a plurality of positioning grooves 14, and a plurality of groove-receiving slots 15. The first cylindrical body 10 and the second cylindrical body 11 each comprise a first terminal end 12 and a second terminal end 13. A distance between the first terminal end 12 and the second terminal end 13 of the first cylindrical body 10 determines the overall length of the first cylindrical body 10. Likewise, a distance between the first terminal end 12 and the second terminal end 13 of the second cylindrical body 11 determines an overall length of the second cylindrical body 11. To establish a connection between the mounting plate 6, the swivel mechanism 9, and the lighting pole 2, the first cylindrical body 10 is perpendicularly mounted onto the mounting plate 6 at the first terminal end 12.

As seen in FIGS. 3-6, the plurality of positioning grooves 14 and the plurality of groove-receiving slots 15 allow the swivel mechanism 9 to lock at different angles. As an example, if the plurality of positioning grooves 14 comprises four grooves and the plurality of groove-receiving slots 15 comprises four receiving slots, the swivel mechanism 9 can lock at 90-degree angles. In another instance, if the plurality of positioning grooves 14 comprises twelve grooves and the plurality of groove-receiving slots 15 comprises twelve receiving slots, the swivel mechanism 9 can lock at 30-degree angles. Thus, the lighting pole 2 that is rotatably engaged with the mounting plate 6 through the swivel mechanism 9 can also be positioned at 30-degree angles.

As seen in FIG. 2 and FIG. 3, for interlocking purposes, the plurality of positioning grooves 14 is externally, radially, and preferably equidistantly distributed at the first terminal end 12 of the first cylindrical body 10. To correspond with the plurality of positioning grooves 14, the plurality of groove-receiving slots 15 is internally, radially, and preferably equidistantly distributed at the first terminal end 12 of the second cylindrical body 11. To complete the swivel mechanism 9, the first cylindrical body 10 is concentrically aligned with the second cylindrical body 11 such that the first cylindrical body 10 is sleeved by the second cylindrical body 11. However, in another embodiment of the present invention, the second cylindrical body 11 can be sleeved by the first cylindrical body 10. In such instances, the plurality of positioning grooves 14 will be internally positioned and the plurality of groove receiving slots 15 will be externally positioned.

When appropriately positioned, the first terminal end 12 of the first cylindrical body 10 is aligned with the first terminal end 12 of the second cylindrical body 11 along an axis of the both the first cylindrical body 10 and the second cylindrical body 11. On the other hand, the second terminal end 13 of the first cylindrical body 10 is aligned with the second terminal end 13 of the second cylindrical body 11. The positioning of the first cylindrical body 10 and the second cylindrical body 11 relative to each other ensures that the plurality of positioning grooves 14 is removably positioned into the plurality of groove-receiving slots 15.

As discussed before, the swivel mechanism 9 in the preferred embodiment is a pull and twist mechanism. A pulling motion disengages the plurality of positioning grooves 14 from the plurality of groove-receiving slots 15 by axially displacing the first cylindrical body 10 and the second cylindrical body 11 from each other. A twisting motion positions each of the plurality of positioning grooves 14 into a new corresponding groove-receiving slot of the plurality of groove-receiving slots 15 by rotating the second cylindrical body 11 about its axis. As further illustrated in FIG. 3, to execute the pulling and twisting motion, the swivel mechanism 9 further comprises a bolt 16, a bolt-receiving channel 17, a spring 18, a washer 19, and a nut fastener 20. The bolt-receiving channel 17, which is concentrically aligned with the first cylindrical body 10 and the second cylindrical body 11, traverses through the mounting plate 6, the first cylindrical body 10, and the second cylindrical body 11. To establish a connection between the mounting plate 6 and the swivel mechanism 9, the spring 18 is compressedly positioned into the bolt-receiving channel 17 at the second terminal end 13 of the second cylindrical body 11. The bolt 16 is then concentrically aligned with the spring 18 and positioned into the bolt-receiving channel 17. When the bolt 16 is positioned through the mounting plate 6, the first cylindrical body 10, and the second cylindrical body 11, the swivel mechanism 9 and the mounting plate 6 are held together through the bolt 16.

The pulling motion and the twisting motion are facilitated by the expansion and compression properties of the spring 18. The washer 19 and the nut fastener 20 are used to hold the bolt 16 against the spring 18 which allows the spring 18 to compress and expand. In doing so, the washer 19 is pressed against the mounting plate 6 opposite the first cylindrical body 10 and terminally engaged with the bolt 16. The nut fastener 20, which is pressed against the washer 19 opposite the mounting plate 6, is also terminally engaged with the bolt 16. Thus, when needed, the bolt 16 can be removed from the bolt-receiving channel 17 by unfastening the washer 19 and the nut fastener 20.

Figure 9:
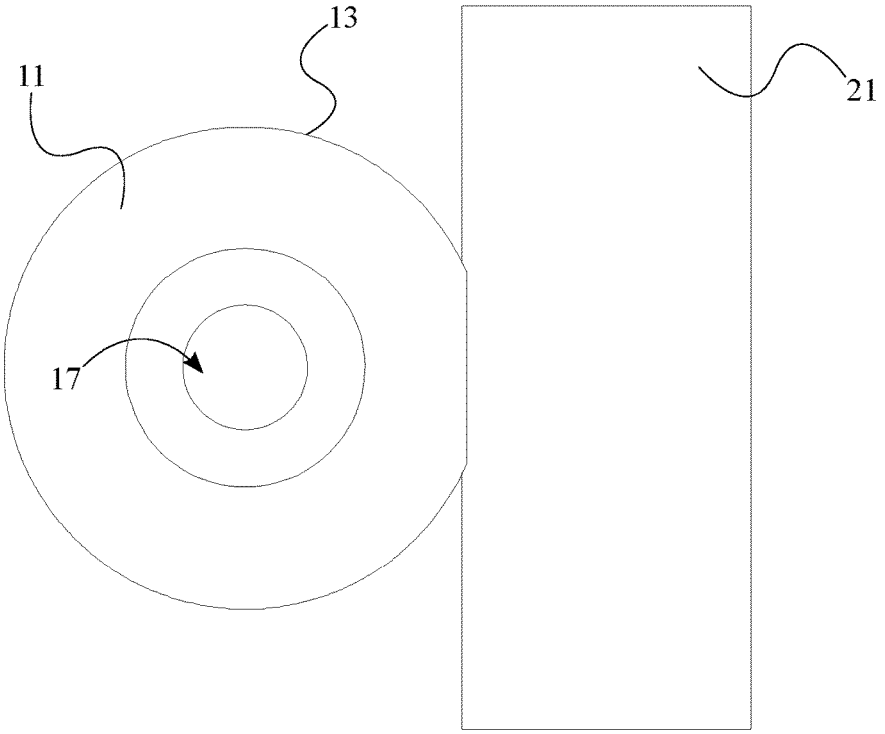
FIG. 9 is a front view of the second cylindrical body and the pole-receiving sleeve.
Figure 10:
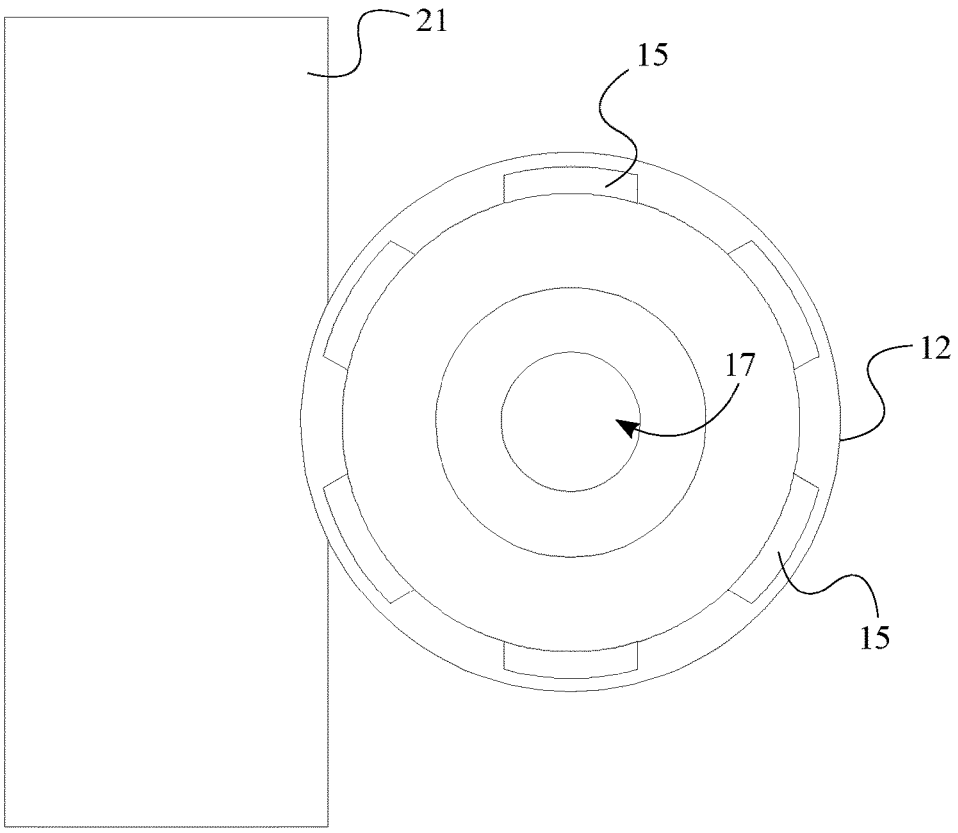
FIG. 10 is a rear view of the second cylindrical body and the pole-receiving sleeve.

As seen in FIG. 9 and FIG. 10, the present invention further comprises a pole-receiving sleeve 21 that is used in the process of rotatably engaging the lighting pole 2 with the mounting plate 6. The pole body 4 is positioned through the pole-receiving sleeve 21 such that the pole-receiving sleeve 21 is positioned adjacent the second end 5 of the lighting pole 2. The pole-receiving sleeve 21 is laterally connected to the second cylindrical body 11 adjacent the second terminal end 13. Thus, the lighting pole 2, the pole-receiving sleeve 21, and the second cylindrical body 11 move simultaneously. Even though the pole-receiving sleeve 21 is permanently mounted onto the pole body 4 in the preferred embodiment, the pole-receiving sleeve 21 can be slidably positioned along the pole body 4 in another embodiment of the present invention.

Figure 8:
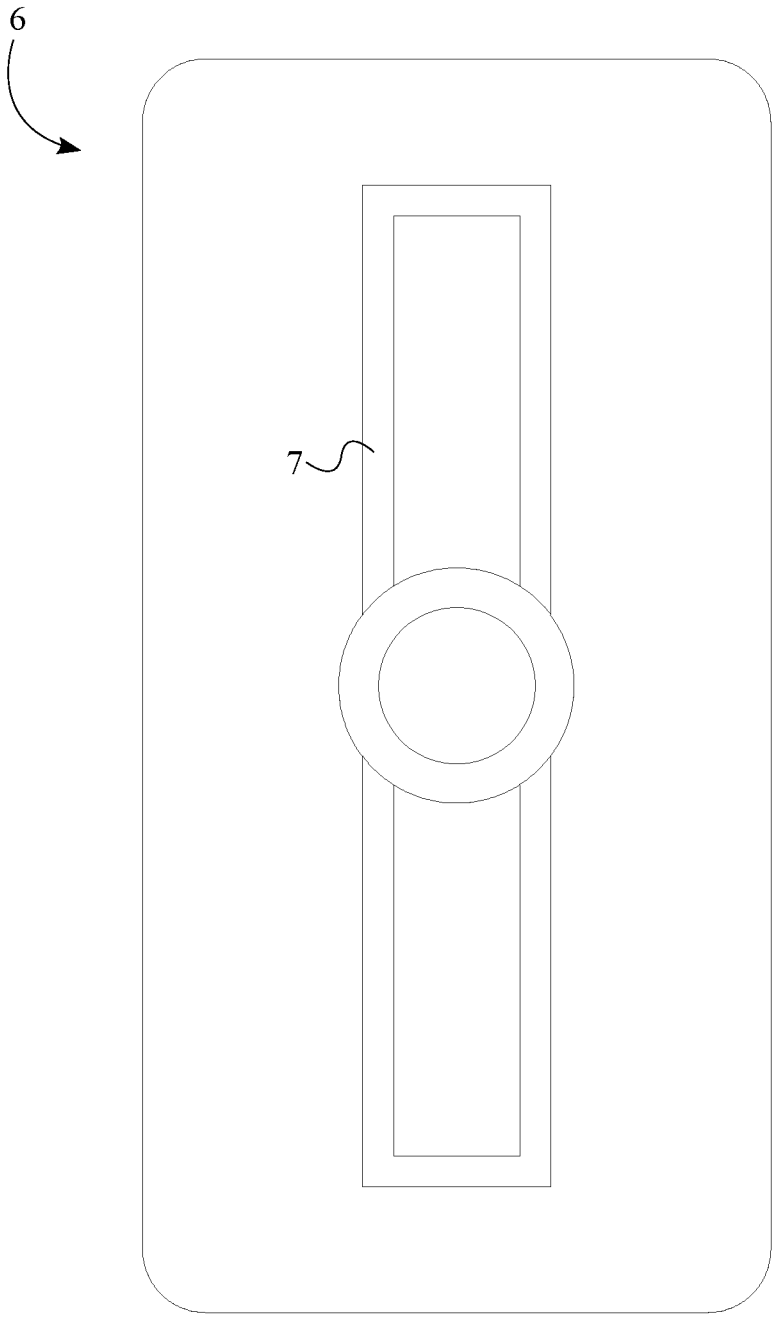
FIG. 8 is a rear view of the mounting plate, wherein the anchor-engaging groove is illustrated.

The present invention is intended to be permanently mounted onto the anchor of the boat. As shown in FIG. 8, to do so, the mounting plate 6 comprises an anchor-engaging groove 7. For the mounting plate 6 to be pressed against the anchor during the mounting process, the anchor-engaging groove 7 is laterally positioned along a structural body of the mounting plate 6. When the first cylindrical body 10 is perpendicularly connected to the mounting plate 6, the anchor-engaging groove 7 is positioned opposite the first cylindrical body 10 and across a structural body of the mounting plate 6. Even though the anchor-engaging groove 7 is used during the mounting process of the preferred embodiment, different mechanisms can be used in other embodiments of the present invention.

Figure 11:
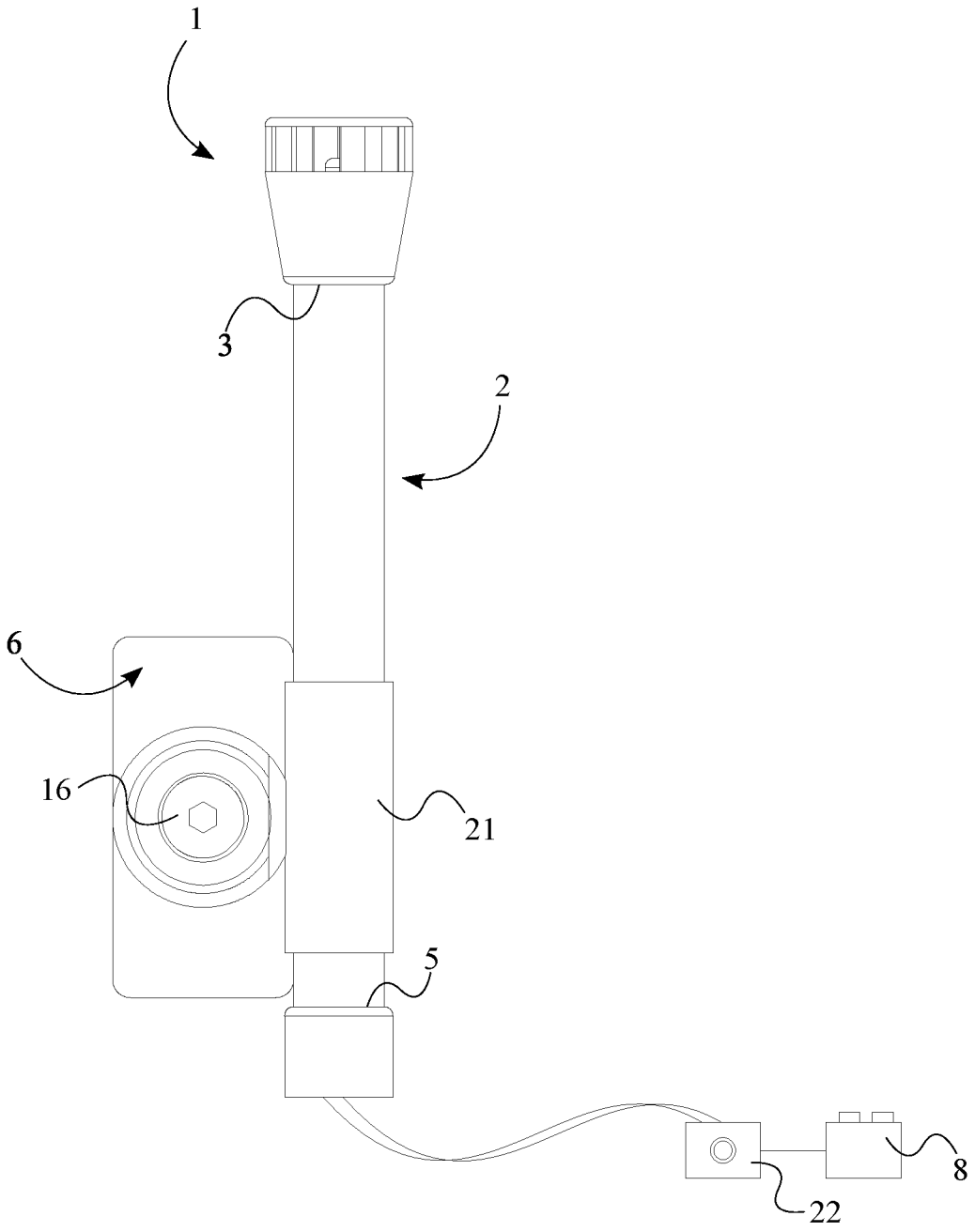
FIG. 11 is an illustration of the electrical connection between the lighting source, the external control switch, and the external power source.

When the present invention is in use, the following process flow is generally followed. Initially, the mounting plate 6 is pressed against the anchor of the boat. In the preferred embodiment, the anchor-engaging groove 7 establishes the connection between the anchor and the mounting plate 6. Next, the lighting pole 2 is rotatably engaged with the mounting plate 6 through the swivel mechanism 9 by positioning the pole body 4 into the pole-receiving sleeve 21. Thus, the user can position the lighting pole 2 and the connected lighting source 1, at a preferred angle. As illustrated in FIG. 11, when the lighting source 1 is positioned at the preferred position, the user utilizes an external control switch 22 to illuminate the lighting source 1. To control the current flow from the external power source to the lighting source 1, the external control switch 22 is electrically connected to the external power source 8 and electronically connected to the lighting source 1. Preferably, the external control switch 22 is a switch on the control panel of the boat.

Although the invention has been explained in relation to its preferred embodiment, it is to be understood that many other possible modifications and variations can be made without departing from the spirit and scope of the invention as hereinafter claimed.

What is claimed is:

1. An anchor light comprises:

a lighting source;

a lighting pole;

a mounting plate;

a swivel mechanism;

the lighting pole comprises a first end, a pole body, and a second end;

the pole body extending from the first end to the second end;

the lighting source being terminally connected to the lighting pole at the first end;

the lighting pole being rotatably engaged with the mounting plate through the swivel mechanism;

the swivel mechanism being positioned adjacent the second end; and the mounting plate being laterally connected to the swivel mechanism opposite the lighting pole;

the swivel mechanism comprises a first cylindrical body, a second cylindrical body, a plurality of positioning grooves, a plurality of groove-receiving slots;

the first cylindrical body and the second cylindrical body each comprise a first terminal end and a second terminal end;

the plurality of positioning grooves being externally and radially distributed at the first terminal end of the first cylindrical body;

the plurality of groove-receiving slots being internally and radially distributed at the first terminal end of the second cylindrical body;

the first cylindrical body being perpendicularly mounted onto the mounting plate at the first terminal end;

the first cylindrical body being concentrically aligned with the second cylindrical body;

the first terminal end of the first cylindrical body being aligned with the first terminal end of the second cylindrical body;

the second terminal end of the first cylindrical body being aligned with the second terminal end of the second cylindrical body; and the plurality of positioning grooves being removably positioned into the plurality of groove-receiving slots.

2. The anchor light as claimed in claim 1 further comprises:

the swivel mechanism further comprises a bolt, a bolt-receiving channel, a spring, a washer, and a nut fastener;

the bolt-receiving channel traversing through the mounting plate, the first cylindrical body, and the second cylindrical body, wherein the bolt-receiving channel is concentrically aligned with the first cylindrical body and the second cylindrical body;

the spring being compressedly positioned into the bolt-receiving channel at the second terminal end of the second cylindrical body;

the bolt being concentrically aligned with the spring and positioned into the bolt-receiving channel;

the washer being pressed against the mounting plate opposite the first cylindrical body; and the nut fastener being pressed against the washer opposite the mounting plate.

3. The anchor light as claimed in claim 1 further comprises:

a pole-receiving sleeve;

the pole-receiving sleeve being laterally connected to a second cylindrical body of the swivel mechanism;

the pole body being positioned through the pole-receiving sleeve; and the pole-receiving sleeve being mounted adjacent a second end of the lighting pole.

4. The anchor light as claimed in claim 3, wherein the pole-receiving sleeve is slidably positioned along a pole body of the lighting pole.

5. The anchor light as claimed in claim 1 further comprises:

the mounting plate comprises an anchor-engaging groove; and the anchor-engaging groove being laterally positioned along a structural body of the mounting plate opposite a first cylindrical body of the swivel mechanism.

6. The anchor light as claimed in claim 1 further comprises:

an external control switch;

an external power source;

the external switch being electrically connected to the external power source;

the external switch being electronically connected to the lighting source; and the lighting source being electrically connected to the external power source.

7. The anchor light as claimed in claim 6, wherein the external power source is 12-volt power source.

* * * * *